United States Patent [19]

Peters

[11] 4,298,209

[45] Nov. 3, 1981

[54] DETACHABLE ROLLER SKATE WITH REAR BRAKE

[76] Inventor: John Peters, 4637 Twentyfifth St., San Francisco, Calif. 94114

[21] Appl. No.: 59,526

[22] Filed: Jul. 23, 1979

[51] Int. Cl.[3] ..... A63C 17/14

[52] U.S. Cl. ..... 280/11.2; 280/11.31; 280/11.33

[58] Field of Search ..... 280/11.3, 11.31, 11.33, 280/11.2, 11.21

[56] References Cited

U.S. PATENT DOCUMENTS

| | | | |
|---|---|---|---|
| 34,590 | 3/1862 | Plimpton | 280/11.3 X |
| 334,281 | 1/1886 | Punches | 280/11.19 |
| 337,151 | 3/1886 | Harris, Jr. | 280/11.2 |
| 341,186 | 5/1886 | Tilden | 280/11.2 |
| 1,542,239 | 6/1925 | Haas | 280/11.2 |
| 2,872,201 | 3/1959 | Wagers | 280/11.2 |
| 3,028,171 | 4/1962 | Davis | 280/11.2 |
| 3,773,339 | 11/1973 | Aranson | 280/11.2 |
| 4,188,046 | 2/1980 | Fleckenstein | 280/618 |

FOREIGN PATENT DOCUMENTS

| | | | |
|---|---|---|---|
| 602147 | 7/1978 | Switzerland | 280/11.3 |
| 28427 | of 1908 | United Kingdom | 280/11.3 |

*Primary Examiner*—Joseph F. Peters, Jr.
*Assistant Examiner*—Milton L. Smith
*Attorney, Agent, or Firm*—Flehr, Hohbach, Test, Albritton & Herbert

[57] ABSTRACT

Roller skate adapted to be removably attached to a shoe or boot. The skate includes a toe clip and a releasable rear binding which enable the skate to be quickly and easily attached to and removed from the shoe. A rearwardly projecting brake provides means for stopping or slowing the movement of the skate.

11 Claims, 6 Drawing Figures

DETACHABLE ROLLER SKATE WITH REAR BRAKE

This invention pertains generally to roller skates and more particularly to a detachable roller skate having a rear brake.

In recent years, outdoor roller skating has enjoyed an upsurge in popularity, particularly among adults. This has been due, at least in part, to the development of improved wheels and bearings which provide a relatively smooth ride even on rough surfaces such as sidewalks, streets and the paved pathways of parks and other recreational areas.

The improved skates are commonly "shoe skates" that is, skates having a shoe or boot to which the wheels and supporting mechanism are permanently or semi-permanently attached. These shoe skates have certain limitations and disadvantages. Being worn in place of regular shoes, the skates generally do not permit the skater to walk or engage in other activities unless he does so without shoes or he carries an extra pair of shoes with him. Also, the shoe skates only fit feet of the same general shoe size, and therefore they have only limited interchangability between users.

Another problem arises because many outdoor skating areas are crowded with persons other than skaters, or they may not be level, and many people have difficulty controlling the speed of their skates in a crowded area or on a downhill slope. Although many skates have toe stops, these are intended primarily as an aid in running starts and figure skating maneuvers, and they are generally not too effective as brakes, particularly on downhill slopes or in quick, emergency stops.

It is in general an object of the invention to provide a new and improved roller skate which overcomes the foregoing and other disadvantages of roller skates of the prior art.

Another object of the invention is to provide a roller skate of the above character which is quickly and easily attached to and removed from a shoe or boot.

Another object of the invention is to provide a roller skate of the above character which has a rear brake for slowing or stopping the movement of the skate.

These and other objects are achieved in accordance with the invention by providing a roller skate having a horizontally extending base plate for receiving the bottom portion of a shoe, wheel trucks mounted on the base plate toward the front and rear ends thereof, a toe clip mounted toward the front end of the base plate for engagement with the forward portion of the shoe, releasable binding means engageable with the rear portion of the shoe for cooperation with the toe clip to secure the skate to the shoe, and brake means projecting rearwardly of the base plate for engagement with the ground when the front portion of the skate is raised pivotally about the wheels of the rear truck.

Figure 1:
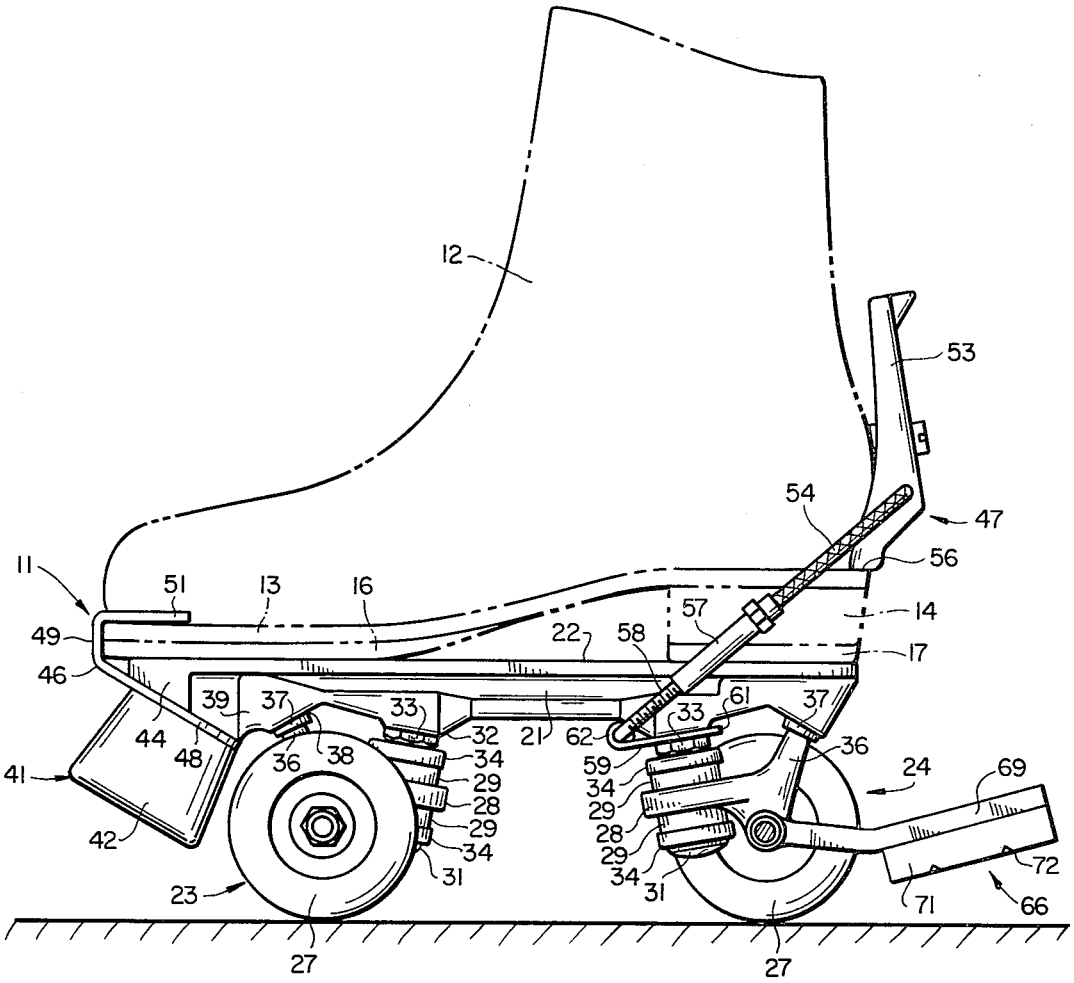
FIG. 1 is a side elevational view of one embodiment of a detachable roller skate having a rear brake in accordance with the invention, with the rear wheel nearest the viewer removed for clarity of illustration.

In FIG. 1, the roller skate, designated generally by the reference numeral 11, is illustrated in conjunction with a shoe 12. In this embodiment, the shoe is a conventional roller skating boot of the type commonly employed in shoe skates. The sole 13 and the heel 14 of the boot have, however, been provided with extra layers of material 16, 17 for traction when walking, for strength and to facilitate attachment of the skate to the shoe. The invention is not limited to this particular type of boot, and it can be employed equally well with a conventional shoe.

The roller skate includes a horizontally extending base plate 21 having an upper surface 22 for supportingly receiving the bottom portion of the shoe. The base plate is fabricated of a rigid material such as metal by a suitable process such as casting, forging, or extrusion.

Wheel trucks 23, 24 are mounted on the underside of base plate 21 toward the front and rear ends of the plate. Front truck 23 is of conventional design and includes a laterally extending axle member 26 on which wheels 27 are rotatively mounted. A mounting lug 28 extends rearwardly from the axle member and is clamped between resilient shock absorber bushings 29 mounted on a vertically extending post which is affixed to the base plate. In the embodiment illustrated, the post comprises an adjustable bolt 31 which is threadedly mounted in a boss 32 on the base plate, with a jam nut 33 for locking the bolt in a desired position. Cup-shaped washers 34 cover the ends of the shock absorber bushings adjacent to nut 33 and the head of bolt 31. The truck also includes a brace member 36 which extends upwardly from axle member 26 toward the front of the base plate. The upper end of the brace member carries a cushioning cap 37 which is abuttingly received in a hemispherical socket 38 formed in a depending boss 39 on the base plate. Axle member 26, mounting lug 28, and brace member 36 are formed as a rigid, unitary structure, and bushings 29, bolt 31 and the nut and washers associated therewith form an adjustable, resilient mount for the truck.

The rear truck is generally similar to the front truck, and like reference numerals are utilized to designate corresponding elements in the two trucks. The rear truck is, however, mounted in a reversed position, with mounting lug 28 facing in a forward direction and brace member 36 inclined upwardly toward the rear end of base plate 21.

A conventional toe stop 41 is mounted on the underside of the base plate in front of front truck 23. The toe stop comprises a resilient body 42 secured to the base plate by a mounting screw 43 which is threadedly received in a depending boss 44. The lower surface of toe stop body 42 is typically inclined forwardly and upwardly at an angle on the order of 30° to the ground or other surface on which the wheels are resting.

Means is provided for releasably securing the skate to the shoe or boot of the skater. This means includes a toe clip 46 and a releasable rear binding assembly 47. The toe clip is mounted in a fixed position at the front of the base plate and includes a lower arm 48 which is clamped rigidly between toe stop element 42 and boss 44, an upright section 49 at the front of the skate, and a rearwardly extending flange 51 spaced above the base for engaging the upper portion of the sole of the shoe. The flange has a cut out area 52 corresponding to the contour of the toe of the shoe, and the flange engages a sufficient portion of the toe to limit both forward and lateral movement of the shoe.

Binding assembly 47 includes a lever 53 which is pivotally mounted on a flexible cable 54 for clamping engagement with the upper lip 56 of sole 13 at the rear of the shoe. The ends of the cable are terminated in adjusting nuts 57 which engage the outer arms of a U-shaped bolt or bail 58. The central arm of this bolt is pivotally mounted about an axis extending laterally of the base plate. In the embodiment of FIG. 1, the binding assembly includes a mounting bracket 59 having a flange 61 clamped in a fixed position between base plate 21 and nut 33 on the mounting post or action bolt 31 for rear truck 24. The central arm of bolt 58 is pivotally mounted in a ferrule 62 at the front of the mounting bracket. If desired, a rigid wire bail can be utilized in place of cable 54.

A brake 66 extends to the rear of rear truck 24 and base plate 21 for engagement with the ground when the front portion of the skate is raised pivotally about the wheels of the rear truck. In the embodiment of FIG. 1, the brake includes an arm 67 which is formed as an integral part of the rear truck. The arm includes an inner portion 68 which extends downwardly from axle member 26 and an outer portion 69 which extends upwardly at an angle on the order of 15° to the ground or the plane of base plate 21. A brake pad 71 is affixed to the lower side of the outer portion of the brake arm, with a lower surface 72 for frictional engagement with the ground to slow or stop the movement of the skate. The position of the brake is preferably such that the pad engages the ground when the front of the skate is raised a distance on the order of three-fourths of the diameter of the rear wheels. The brake pad is fabricated of rubber such as a piece of tire tread or another suitable material having a relatively high coefficient of friction, and brake arm 67 is formed as unitary structure with axle member 26, mounting lug 28, and brace member 36 of the rear truck.

Operation and use of the skate is as follows. Nuts 57 are adjusted in accordance with the length of the shoe with which the skate is to be used. The shoe is then placed on the upper surface of base plate 21, and the forward portion of the sole is slid under flange 51 of toe clip 46 so that the flange engages the shoe around the periphery of the toe. The inner end of lever 53 is then placed on the upper lip of the sole at the rear of the shoe, and the outer end of the lever is moved to an upright position against the rear of the shoe to urge the shoe forward against the toe clip and, at the same time, to clamp the heel down against the base plate. The skate is removed simply by flipping the lever down and sliding the shoe back or pushing the skate forward to disengage the toe clip.

The brake is applied by pressing pad 72 down into frictional engagement with the ground behind the skate. This is most easily done by placing one foot in front of the other and lifting the front wheels of the front skate while the remaining wheels remain in contact with the ground. The front of the skate is pivoted upwardly in this manner until the brake pad contacts the ground with the desired force. The 15° angle of inclination for the brake pad has been found to place the braking foot in an optimum position for most skaters. For some skaters, however, it may be desirable to incline the brake pad at a greater or lesser angle. For a more abrupt stop, the brakes can be applied simultaneously with both feet.

Figure 2:
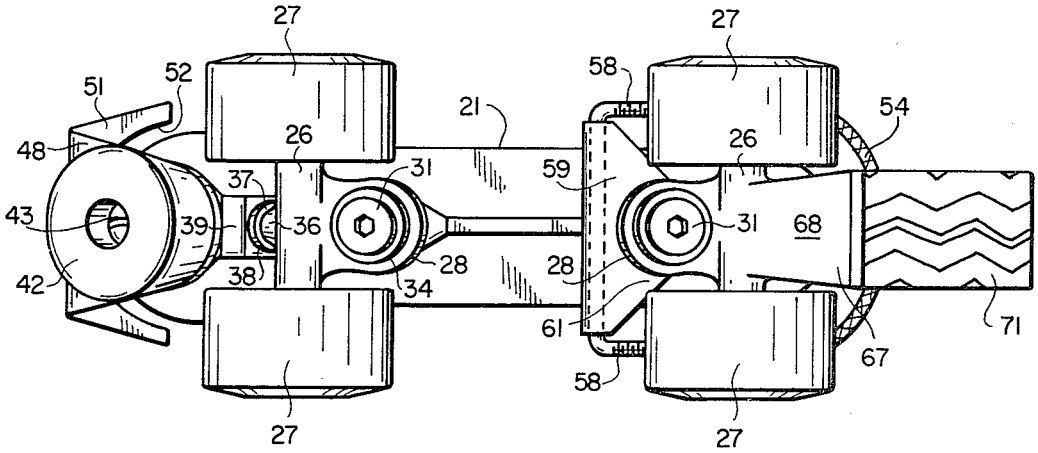
FIG. 2 is a bottom plan view of the roller skate of FIG. 1.
Figure 3:
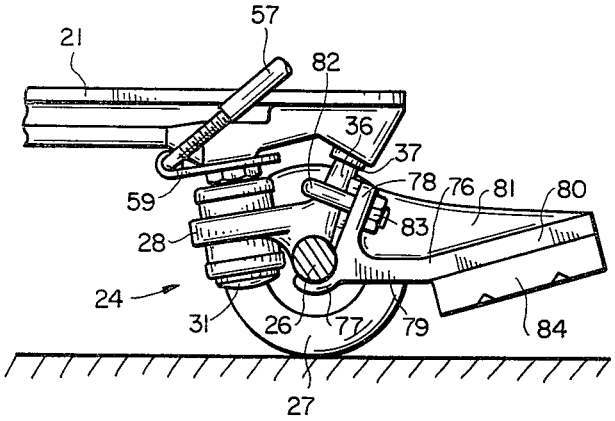
FIG. 3 is a fragmentary side elevational view of another embodiment of a roller skate incorporating the invention, with the wheel nearest the viewer removed for clarity of illustration.

The embodiment of FIG. 3 is generally similar to the embodiment of FIGS. 1–2, and like reference numerals are used to designate corresponding elements. In this embodiment, however, rear truck 24 is identical to front truck 23, and a brake arm 76 is removably mounted on the rear truck, rather than being formed as an integral part of that truck. Arm 76 includes a laterally extending flange 77 which engages the lower and rear portions of axle member 26, an upstanding arm 78 which engages the rear portion of brace member 36, an inner arm portion 79 which extends rearwardly from the axle member, and an outer arm portion 80 which is inclined upwardly and rearwardly at an angle on the order of 15° to the ground and base plate. A brace 81 extends between arm 78 and arm portions 79,80. The brake arm is releasably secured to the rear truck by means of a U-bolt 82 which encompasses brace member 36 and is secured by nuts 83. A brake pad 84, similar to brake pad 71, is mounted on the lower side of arm portion 80.

Figure 4:
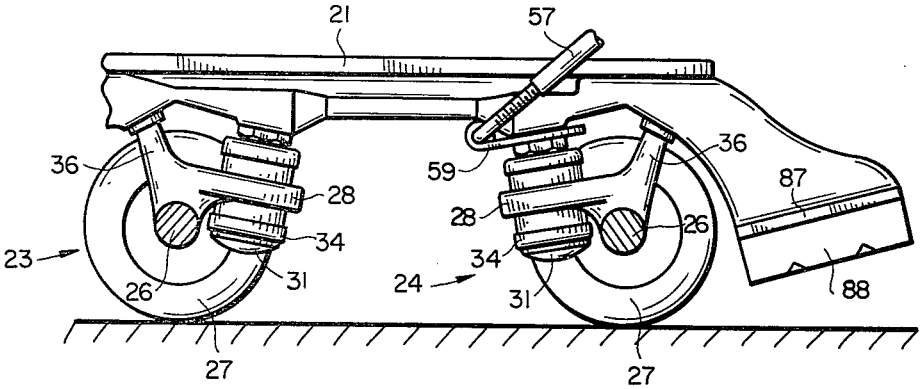
FIG. 4 is a fragmentary side elevational view of another embodiment of a roller skate incorporating the invention, with the wheels nearest the viewer removed for clarity of illustration.

The embodiment of FIG. 4 is also generally similar to the embodiment of FIGS. 1–2, and like reference numerals are again used to designate corresponding elements. In the embodiment of FIG. 4, the front and rear trucks are identical, and the brake includes an arm 86 which extends downwardly and rearwardly from base plate 21 to the rear of rear truck 24. Arm 86 is formed as an integral part of the base plate, and it terminates at its lower end in a flange 87 which is inclined upwardly at an angle on the order of 15° to the ground or base plate. A brake pad 88 is mounted on the underside of this flange.

Operation and use of the embodiments of FIGS. 3 and 4 is similar to that described above for the embodiment of FIGS. 1–2.

Figure 5:
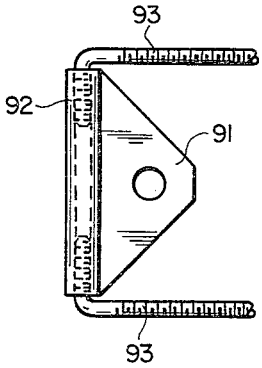
FIGS. 5 and 6 are fragmentary plan view of alternate embodiments of the mounting for the binding in the roller skate of the invention.
Figure 6:
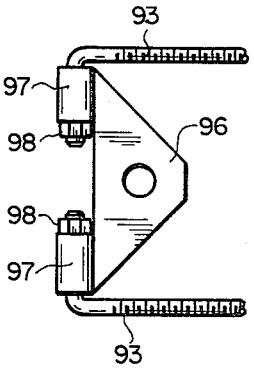

FIGS. 5 and 6 illustrate alternate embodiments for attaching the rear binding to the base plate of the skate. In the embodiment of FIG. 5, a mounting bracket 91 having a single internally threaded ferrule 92 is employed. This bracket is mounted on post 31 of rear truck in a manner similar to bracket 59, and the inwardly extending arm of L-shaped bolts 93 are threadedly received in the ferrule. In this embodiment, the binding is adjusted for width by turning bolts 93 in the ferrule and then attaching length adjusting nuts 57 to the outer arms of bolts 93.

In the embodiment of FIG. 6, mounting bracket 96 has a pair of axially spaced apart ferrules 97 thru which the inwardly extending arms of L-shaped bolts 93 extend. Nuts 98 mounted on these arms permit the binding to be adjusted for shoes of different widths.

Rather than using a separate mounting bracket for the rear binding, a laterally extending bore can be formed in the base plate. This bore can be threaded to receive the inwardly extending arms of L-bolts 58, or it can be left unthreaded when a bolt or bail similar to U-bolt 96 is employed.

The invention has a number of important features and advantages. It provides a roller skate which is quickly and easily attached and detached. The skate can be used with conventional shoes as well as special skating boots, and it can accommodate a variety of shoe sizes. The rear brake provides safe, efficient means for stopping or slowing the movement of the skate.

It is apparent from the foregoing that a new and improved roller skate has been provided. While only certain presently preferred embodiments have been described, as will be apparent to those familiar with the art, certain changes and modifications can be made without departing from the scope of the invention as defined by the following claims.

What is claimed is:

1. In a roller skate: a horizontally extending base having an upper surface for receiving the bottom portion of a shoe, wheel trucks mounted on vertically extending posts toward the front and rear of the base, a toe stop projecting downwardly from the base in front of the front truck, a toe clip secured between the toe stop and the base and extending upwardly about the base for engagement with the front portion of the shoe to limit forward and lateral movement of the shoe on the base, a mounting bracket having a flange affixed to the mounting post of the rear truck and a ferrule extending laterally of the base in front of the rear truck, and a releasable binding pivotally mounted in the mounting bracket ferrule and engageable with the rear portion of the shoe for cooperation with the toe clip to secure the skate to the shoe.

2. The roller skate of claim 1 wherein the toe clip includes a rearwardly extending flange spaced above the base with a contour corresponding to the toe of the shoe for engagement with the upper portion of the sole of the shoe.

3. The roller skate of claim 1 wherein the releasable binding includes a lever pivotally mounted on a bail for engagement with the upper lip of the sole at the rear of the shoe.

4. In a roller skate: a horizontally extending base having an upper surface for receiving the bottom portion of a shoe, wheel trucks mounted on substantially vertically extending posts toward the front and rear of the base, a toe stop projecting downwardly from the base in front of the front truck, a toe clip extending upwardly about the base for engagement with the front portion of the shoe to limit forward and lateral movement of the shoe on the base, a mounting bracket having a flange affixed to the mounting post of the rear truck and a ferrule extending laterally of the base, a releasable binding mounted in the mounting bracket ferrule and engageable with the rear portion of the shoe for cooperation with the toe clip to secure the skate to the shoe, and brake means projecting rearwardly of the rear truck for engagement with the ground when the forward portion of the skate is raised pivotally about the rear truck wheels.

5. The roller skate of claim 4 wherein the brake means includes a rearwardly extending rigid arm formed as an integral part of the rear truck, and a downwardly facing brake pad carried by the arm.

6. The roller skate of claim 4 wherein the brake means includes a rearwardly extending arm removably clamped to the rear truck.

7. The roller skate of claim 4 wherein the brake means is formed as an integral part of the base extending downwardly and rearwardly to a position to the rear of the rear truck, and a brake pad carried by the arm.

8. In a roller skate: a horizontally extending base having an upper surface for receiving the bottom portion of a shoe, wheel trucks mounted on substantially vertically extending posts toward the front and rear of the base, a retaining clip secured to the base for engagement with one end portion of the shoe to limit movement of the shoe on the base, a mounting bracket having a flange affixed to the mounting post of one of the trucks and a ferrule extending laterally of the base, and a releasable binding mounted in the mounting bracket ferrule and engageable with the other end portion of the shoe for cooperation with the toe retaining to secure the skate to the shoe.

9. The roller skate of claim 8 further including brake means projecting rearwardly of the rear wheels for engagement with the ground when the forward portion of the skate is raised pivotally about the rear wheels.

10. The roller skate of claim 9 wherein the rear truck includes a laterally extending axle member and a brace member inclined upwardly toward the rear end of the base plate, and the brake means includes an arm engageable with the axle member and the base member, and clamping means engaging the brace member for securing the brake member to the truck.

11. The roller skate of claim 9 wherein the brake means includes an arm formed as an integral part of the base extending downwardly and rearwardly behind the rear truck and terminating in an upwardly and rearwardly inclined flange, with a downwardly facing brake pad mounted on said flange.

* * * * *